US005181664A

United States Patent [19]

Kohler

[11] Patent Number: 5,181,664

[45] Date of Patent: Jan. 26, 1993

[54] GRINDING PLATE WITH ANGLED OUTER BARS

[75] Inventor: Gregory R. Kohler, Williamsport, Pa.

[73] Assignee: Andritz Sprout-Bauer, Inc., Muncy, Pa.

[21] Appl. No.: 870,584

[22] Filed: Apr. 17, 1992

[51] Int. Cl.[5] ..... B02C 7/12

[52] U.S. Cl. ..... 241/261.3; 241/296

[58] Field of Search ..... 241/261.2, 261.3, 260, 241/296, 297, 298

[56] References Cited

U.S. PATENT DOCUMENTS

| | | | |
|---|---|---|---|
| 183,664 | 10/1876 | Grigg et al. | 241/296 |
| 2,654,295 | 10/1953 | Sutherland | 241/296 |
| 4,023,737 | 5/1977 | Leider et al. | 241/261.3 |
| 4,039,154 | 8/1977 | Peterson | 241/261.3 |
| 4,237,589 | 12/1980 | Boothe | 241/261.3 |
| 4,635,864 | 1/1987 | Peterson et al. | 241/261.3 |
| 5,112,443 | 5/1992 | Virving et al. | 241/261.3 |

*Primary Examiner*—Douglas D. Watts
*Assistant Examiner*—Scott A. Smith
*Attorney, Agent, or Firm*—Chilton, Alix & Van Kirk

[57] ABSTRACT

A grinding plate (10) for the face (104) of a refiner disc (100) having a center and a substantially circular periphery (102), comprises a plurality of grinding plate segments (12) arranged side-by-side on the face (104) of the disc to form a substantially annular refining region (14) having an inner edge (22) near the center and an outer edge (24) near the periphery of the disc. Each plate segment (12) extends substantially radially and has a pattern of bars and grooves between bars, whereby material to be refined and steam produced during refining, can flow in the grooves in the general direction from the inner edge (22) toward the outer edge (24) of the refining region (14). The pattern includes an inner pattern (18) of substantially radially oriented inner bars (30) and inner grooves (32), substantially each inner groove having dam structure (34) for interrupting radial flow of material therethrough and an outer pattern (20) of outer bars (36) and outer grooves (38), defining flow channels (48) extending from the inner pattern (18) to the outer edge (24) of the plate segment (12) at an angle of at least about 45 degrees relative to the general direction of flow through the inner grooves (32). The flow channels (48) do not have surface dams.

21 Claims, 2 Drawing Sheets

GRINDING PLATE WITH ANGLED OUTER BARS

BACKGROUND OF THE INVENTION

The present invention relates to a disk grinder or the like, and more particularly, to the grinding plate segments for such an apparatus.

In high consistency mechanical pulp refiners, the wood fibers are worked between two refiner plates which usually have radial bars and grooves. A large volume of steam is produced between the plates as a result of this refining work. For effective refining, the fibers must be retained between the plates on the bar surfaces despite the high velocity of the flowing steam, and the enormous centrifugal forces. Typically, dams are provided in the grooves, to interrupt material flow and thus improve the retention time of the material in the refining region.

In a typical refiner plate with radial bars and grooves, the bars provide impacts or pressure pulses which separate and fibrillate the fibers. The grooves enable feeding and steam extraction. Near the perimeter, a high radial steam flow and centrifugal force both act to sweep the fibers from between the plates, thus reducing the refining effectiveness. The flow restrictions of a small plate gap and fiber-filled grooves result in a steam pressure peak between the plates. This pressure peak is a major portion of the refining thrust, and contributes to control instability at high motor loads. Dams in the grooves help to retain the fibers and force them to the bar surface. However, they also further restrict the steam flow.

It is thus desirable that the steam generated during refining be discharged from the refining region as quickly as possible, while retaining the pulp within the region as long as possible. U.S. Pat. No. 4,676,440 discloses a grinding plate pattern which includes exhaust channels to assist in the removal of steam from the refining region. The patent more specifically discloses two oppositely placed grinding disc plates, each made up of several segments attached to each other, at least one of the discs being rotatable. The segments are provided with a rough surface or with bars and grooves for the grinding of material such as wood chips. The segments of at least one of the plates are provided with one or more exhaust channels having a sectional area essentially larger than that of the grooves. The exhaust channels are superimposed on, and span, the outer two of three refining zones arranged on the plate in the direction of material passage. One significant disadvantage arises from the fact that the fabrication of the plate surface of the type disclosed in U.S. Pat. No. 4,676,440, is quite costly.

SUMMARY OF THE INVENTION

It is therefore an object of the present invention to provide a grinding plate for the face of a refiner disc, which facilitates the removal of steam while retaining the pulp in the refiner region to achieve satisfactory pulp quality.

This object is achieved by providing a grinding plate constituted from a plurality of grinding plate segments, each having an inner edge and an outer edge, between which at least two distinct bar and groove patterns are provided. An inner pattern of substantially radially oriented inner bars and inner grooves defines a primary refining zone. In this zone, each groove has at least one surface or subsurface dam for interrupting the radial flow of material therethrough during operation of the refiner. An outer pattern of outer bars and grooves establishes a secondary refining zone extending from the first refining zone to the outer edge of the plate segment. The outer bars and grooves define flow channels extending at an angle of at least about 45° relative to the general direction of the inner grooves in the primary refining zone. The flow channels in the outer refining zone do not have any surface dams, and preferably no dams of any kind. Preferably, the cross-sectional area of each channel in the outer refining zone is larger than the cross-sectional area of each of the inner grooves, thereby facilitating removal of steam. The walls and base of the channel are preferably asymetric, so that as the channels rotate with the disc, the solids are guided by the wall structure upwardly toward the upper surface of a bar where further refining takes place. With the present invention, the outer refining zone is preferably situated radially outward from steam pressure peak, to the grinding plate circumference. The bars and grooves at the outer refining zone would typically lie within an annulus coextensive with the forward flowing steam, on an angle of at least 45°, and preferably 60° from radial, thereby providing a steam flow path across, i.e., oblique to, the direction of centrifugal force. Centrifugal force carries the fibers across the grooves and reloads the fibers on to the next outer bar surface along the entire length of each outer groove in the refining region. This avoids the need for dams, and facilitates guidance of the fibers to the bar surfaces over a much greater area than occurs with the conventional, concentrated transfer at each dam. The flow channels defined by the grooves in the outer zone of the present invention, can be wider than conventional, and in particular, wider than the grooves in the primary, inner zone, because the fibers in each channel are continually forced back to a bar surface and will not travel along the groove a substantial distance, as is the case with a radial bar and groove pattern.

The angle in the bottom of the outer grooves preferentially directs the fibers toward the top surface of the next bar, thereby clearing an open channel for steam flow along the leading wall of the channel. The finer fibers that are more affected by steam flow are carried forward in the channel ahead of the denser, less fibrillated fibers, which reload onto the bar surface. This classification produces a more uniform pulp with less energy.

The angled bars and grooves in the outer zone in one sense, serve the same purpose as do surface dams in a conventional plate. However, the increase in open area in the channel and a lack of restrictive dams provides less resistance to the steam flow out of the refiner plate. Typically, with conventional plates, the difficult design conflict is between allowing sufficient area for the steam to flow out while retaining the fiber in the refining zone as long as possible. The benefits of freer steam flow with the present invention, are that peak steam pressure between the plates is reduced, thus reducing the overall thrust and mechanical loadings on the refiner, and improving operational stability by preventing the steam flow in the outward direction from adding to the centrifugal force acting to throw the fiber out of the plates.

In this manner, the invention improves peripheral steam extraction, while enhancing the control of fibers onto the bar surfaces. The benefits of the present invention can be achieved even when only one rotating disc carries the plate segments of the invention, run against a conventional radial pattern on a confronting stationary plate.

BRIEF DESCRIPTION OF THE DRAWINGS

These and other objects and advantages of the invention will be described more fully below with reference to the accompanying drawings, in which.

DESCRIPTION OF THE PREFERRED EMBODIMENT

Figures 1, 2:
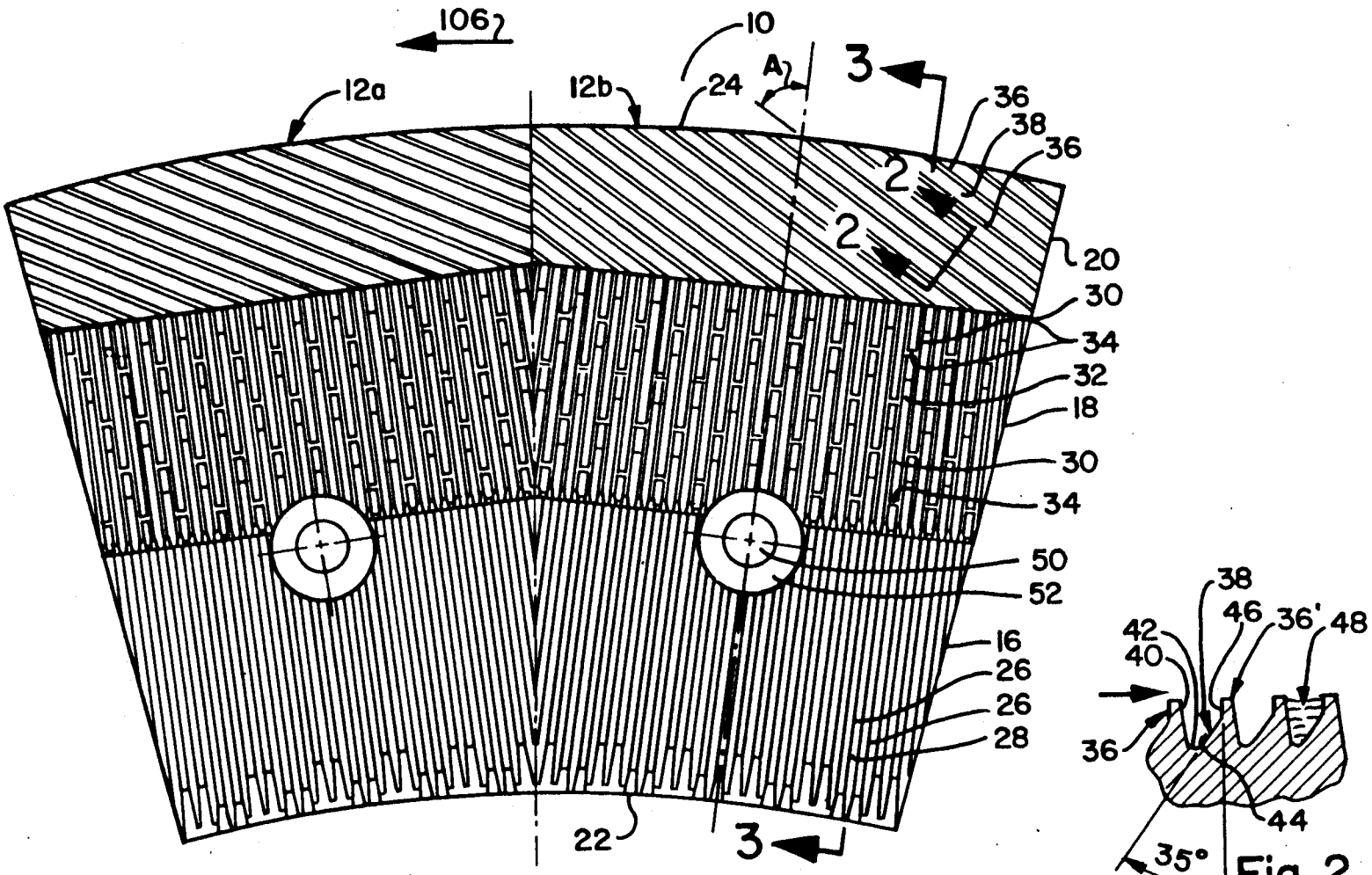
FIG. 1 is an elevation view of two grinding plate segments in accordance with the invention.
FIG. 2 is a section view along line 2—2 of FIG. 1.
Figure 3:
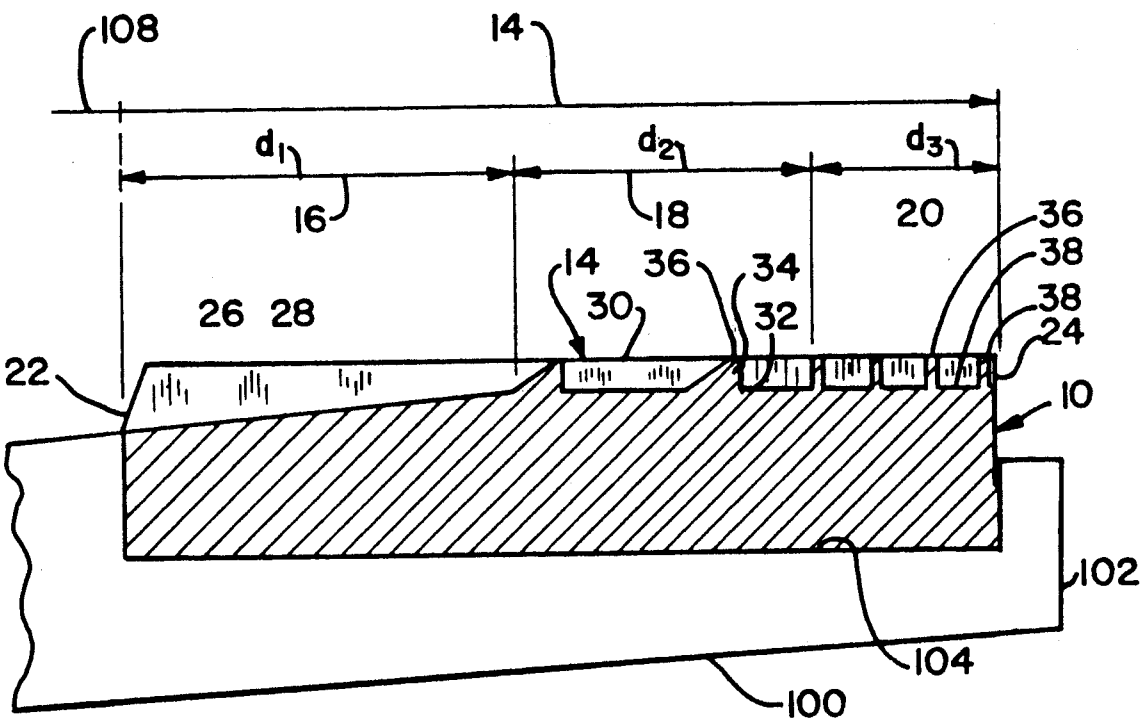
FIG. 3 is a section view along line 3—3 of FIG. 1.

FIG. 1 shows a portion of a grinding plate 10, consisting of a grinding plate segment 12 having portions **12*a*,12*b* which, as shown in FIG. 3, are securable to the front face 104 of a substantially circular refiner disc 100. Although in the illustrated embodiment the unitary segment 12 has substantially identical portions 12*a*,12*b*, each portion 12*a*,12*b* could alternatively be provided as a unitary segment. The plate portions or segments 12 are attached to the disc face 104, in any convenient or conventional manner, such as by bolts (not shown) passing through bores 50. One end of the bolt engages the disc and at the other end has head structure bearing against a countersunk surface 52. The disc, only a portion of which is shown, has a center about which the disc rotates, and a substantially circular periphery 102. The grinding plate segments 12*a*,12*b* are arranged side-by-side on the face 104 of the disc, to form a substantially annular grinding face, shown generally at 14. The face 14** forms a portion of a grinding region, when confronting another grinding plate (not shown) carried by another disc.

Each grinding plate portion or segment **12*a*,12*b* has an inner edge 22 nearer the center of the disc, and an outer edge 24 nearer the periphery 102 of the disc. The remainder of this description will refer to a single plate segment 12, but it should be understood that all the segments which define the annular plate, are preferably substantially similar. Each such plate segment 12 extends substantially radially, i.e., in the direction indicated by the arrow 108 representing the radius of disc 100. The plate segment 12 has, on its face 14, at least two, and preferably three distinct patterns of bars and grooves between bars, whereby material to be refined and steam produced during refining, can flow in the grooves in the general direction from the inner edge 22 to the outer edge 24** of the plate segment.

In the embodiment illustrated in FIGS. 1 and 3, a first, or inlet zone 16 has a multiplicity of bars 26 and grooves 28 between adjacent bars, all of which extend in parallel, substantially in the radial direction. This pattern 16 is especially adapted for receiving wood chips or the like and performing an initial grinding operation thereon to reduce the size of the chips and funnel them radially outward into the second zone 18. Zone 18 has a multiplicity of bars 30 and grooves 32 between adjacent bars, which also extend in parallel, substantially radially.

Since the disc 100 and plate 10 rotate, the partially refined material is directed, as a result of centrifugal force, radially outward. In order to maintain this material in the second refining zone 18 as long as possible, each groove 32 has at least one, and preferably two, dams 34. As shown in FIG. 3, these dams 34 are preferably surface dams (but could be subsurface dams), which means that the dams extend upwardly so that the top surface 36 is at the same elevation as the top surface of the adjacent bars 30. As described above, the dams 34 interrupt the flow of material through the grooves 32, forcing the material onto the adjacent bars for further refining. In the second refining zone 18, substantial quantitites of steam are also generated, producing a steam flow with high radially outward velocity.

Especially with relatively large discs, the centrifugal forces acting on the steam and partially refined chips increase dramatically as the material moves farther and farther radially outward. Although it is highly desirable that the steam be quickly exhausted from the refining region, it is essential that the partially refined fibers not be prematurely exhausted along with the steam. This condition is influenced by the radial pressure profile along the disc face due to steam generated by the refining at high consistency. Since the pressure peak is between the inner and outer edges 22,24 of the plate 10, the steam flows forward (radially outward) from the outer side of the pressure peak and backward (radially inward) inside the pressure peak, against the material feed.

In accordance with the present invention, an outer refining zone 20 is provided between the primary refining zone 18 and the outer edge 24 of the plate, and is especially adapted to quickly exhaust steam while providing additional refining action on the fibers discharged from the primary refining zone 18. The pattern of bars 36 and grooves 38 in the outer refining zone 20 define relatively wide flow channels, as compared with the flow area in the grooves 32 on the pattern in the primary refining zone 18 situated immediately radially inward of the outer zone 20. The bars and grooves 36,38 in the outer zone 20 extend from the inner pattern 18 to the outer edge 24 of the plate segment 12, at an angle of at least about 45°, and preferably 60°, relative to the disc radius 108. In other words, the angle A of the bars and grooves 36,38, is at least about 45° relative to the general direction of flow through the grooves 32 of the zone 18. Moreover, the grooves 38 in the outer refining zone 20, do not have surface dams, and preferably have no dams of any kind.

FIG. 2 is a cross-section view of the bars and grooves 36,38 in the outer refining zone 20. A given groove 38 is situated between a leading bar 36 and a trailing bar 36', where the terms "leading" and "trailing" refer to the direction of rotation 106. The leading wall 40 of groove 38, defined by the trailing wall of bar 36, is nearly vertical and extends down to the base 42 of the groove. The trailing wall of groove 38 is defined by a portion of the trailing bar 36' and is substantially vertical only near the top surface of bar 36'. An oblique wall portion 44 extends from the groove base 42 to the wall portion 46, thereby defining an asymetric groove boundary. The cross-sectional area within the groove boundary, shown schematically at 48 in FIG. 2, defines a steam exhaust flow channel that is substantially larger, i.e., at least twice as large as the cross-sectional flow area of each groove 32 in the primary refining zone 18.

As a result of the angular orientation of the bars 36 and grooves 38 in the outer refining zone 20, and the centrifugal forces acting on the steam and partially refined fibers, a natural separation of steam and fibers occurs in an advantageous manner. The steam, unimpeded by dams in the channels 38, flows relatively easily through the channels and exhausts at the outer edge 24. The fiber, being heavier, is thrown toward the trailing wall 46 of each groove 38 and is thereby forced onto the upper surface of the trailing bar 36, for additional refining action.

Preferably, the radial extent of the outer refining zone 20, indicated by dimension d3 in FIG. 3, is approximately equal to the distance from the pressure peak to the outer edge 24. In the illustrated embodiment, dimension d3 is less than one-fourth of the total radial extent of the face 14 of the plate segment 12. In the illustrated embodiment having three refining zones 16,18,20, the radial dimension d1 of zone 16 is greater than the radial dimension d2 of zone 18, which in turn is greater than the radial dimension of d3 of zone 20.

The present invention should not be limited to a plate segment 12 having three zones, however, but rather is also advantageously implemented on a two-zone segment. For example, with reference to FIG. 1, the bar and groove pattern of zone 18 could extend along the face of the segment 12 to the inner edge 22. Whether the dimension (d1+d2) is associated with two zones 16,18 as shown in FIG. 3, or only one zone, is a matter of engineering choice for a particular end use or application. Generally, the dimensions d3 would be on the order of a few inches, but the preferred value depends, as indicated above, on the best estimate of the location of the pressure peak in a given refiner design.

In any event, the invention contemplates an inner zone or pattern of substantially radially oriented bars 30 and narrow inner grooves 32 having dams for interrupting the radial flow of material therethrough, and an outer zone 20 of outer bars 36 and wide outer grooves 38 defining flow channels 48 extending from the inner pattern 18 to the outer edge 24 of the plate at an angle of at least about 45° relative to the inner grooves 32. The channels 48 extend from the grooves 32 of the inner zone 18, to the outer edge 24 of the plate, substantially in the direction of disc rotation 106, and have little or no dam structure for interrupting flow.

I claim:

1. A grinding plate for the face of a refiner disc having a center and a substantially circular periphery, comprising:

a plurality of grinding plate segments arranged side-by-side on the face of the disc to form a substantially annular refining region having an inner edge near the center and an outer edge near the periphery of the disc;

each plate segment extending substantially radially and having a pattern of bars and grooves between bars, whereby material to be refined and steam produced during refining, can flow in the grooves in the general direction from the inner edge toward the outer edge of the refining region, the pattern including, an inner pattern of substantially radially oriented inner bars and inner grooves, substantially each inner groove having dam structure for interrupting radial flow of material therethrough, and an outer pattern of outer bars and outer grooves, defining flow channels extending from the inner pattern to the outer edge of the plate segment at an angle of at least about 45 degrees relative to said general direction of flow through the inner grooves, wherein the flow channels do not have surface dams.

2. The grinding plate of claim 1, wherein the cross sectional area of each channel is greater than the cross sectional area of each inner groove.

3. The grinding plate of claim 1, wherein the refining region includes a third pattern of third grooves and third bars situated between the inner pattern and the disc center, for receiving and partially refining relatively coarse material and passing the partially refined material from the third grooves to the inner grooves of the inner pattern.

4. The grinding plate of claim 1, wherein said angle of the channels is about 60 degrees.

5. The grinding plate of claim 1, wherein the grinding plate and patterns thereon have respective radial dimensions along a radius of the disc, and the radial dimension of the outer pattern is less than the radial dimension of the inner pattern.

6. The grinding plate of claim 1, wherein each of the inner grooves has at least two surface dams.

7. The grinding plate of claim 1, wherein the disc is mounted for rotation in a particular direction and the channels extend from the inner pattern to the outer edge of the refining region substantially in the direction of disc rotation.

8. The grinding plate of claim 7, wherein the flow channels are uninterrupted by any dams.

9. The grinding plate of claim 8, wherein each channel is defined by a first substantially vertical wall which leads the groove in the direction of rotation, a groove base, and a second wall having a substantially vertical wall portion which trails the groove in the direction of rotation, and another portion extending obliquely upward from groove base to the substantially vertical portion of the second wall.

10. The grinding plate of claim 8, wherein the cross sectional area of each channel is greater than the cross sectional area of each inner groove.

11. The grinding plate of claim 10, wherein the grinding plate and patterns thereon have respective radial dimensions along a radius of the disc, and the radial dimension of the outer pattern is less than the radial dimension of the inner pattern.

12. The grinding plate of claim 10, wherein each channel is defined by a first substantially vertical wall which leads the groove in the direction of rotation, a groove base, and a second wall having a substantially vertical wall portion which trails the groove in the direction of rotation, and another portion extending obliquely upward from groove base to the substantially vertical portion of the second wall.

13. The grinding plate of claim 10, wherein said angle of the channels is about 60 degrees.

14. The grinding plate of claim 10, wherein the refining region includes a third pattern, of third grooves and third bars situated between the inner pattern and the disc center, for receiving and partially refining relatively coarse material and passing the partially refined material from the third grooves to the inner grooves of the inner pattern.

15. The grinding plate of claim 14, wherein the grinding plate and patterns thereon have respective radial dimensions along a radius of the disc, and the radial dimension of the outer pattern is less than the radial dimension of the inner pattern.

16. The grinding plate of claim 14, wherein the third grooves, in the third pattern, have no dam structure.

17. The grinding plate of claim 7, wherein the plate is mounted for rotation in a high consistency pulp refiner such that steam is generated in said refining region, some of said steam flowing radially outward and some flowing radially inward in the refining region; and the radial dimension of the outer pattern is substantially coextensive with the outwardly flowing steam in the refining region.

18. The grinding plate of claim 1, wherein the flow channels have no dam structure.

19. The grinding plate of claim 18, wherein each dam in the inner grooves is a surface dam.

20. The grinding plate of claim 19, wherein each inner groove has at least two surface dams.

21. The grinding plate of claim 1, wherein each dam in the inner grooves is a surface dam.

* * * * *